US006782830B1

(12) United States Patent
Candland et al.

(10) Patent No.: US 6,782,830 B1
(45) Date of Patent: Aug. 31, 2004

(54) OBTURATOR FOR LARGE CALIBER SMOOTH BORE AMMUNITION

(75) Inventors: Calvin T. Candland, Eden Prairie, MN (US); Dipak S. Kamdar, Maple Grove, MN (US); Rollie H. Dohrn, Cottage Grove, MN (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 10/660,417

(22) Filed: Sep. 11, 2003

(51) Int. Cl.[7] ..... F42B 13/16; F42B 11/00

(52) U.S. Cl. ..... 102/526; 102/527; 102/439; 102/521

(58) Field of Search ..... 102/525–527, 102/439, 521, 506, 517, 501, 522, 523

(56) References Cited

U.S. PATENT DOCUMENTS

| | | | | | |
|---|---|---|---|---|---|
| 3,460,478 | A | * | 8/1969 | Ormanns | 102/526 |
| 4,242,961 | A | | 1/1981 | Moredock | |
| 4,444,113 | A | | 4/1984 | Campoli | |
| 4,487,131 | A | * | 12/1984 | Luther | 102/523 |
| 4,520,731 | A | * | 6/1985 | Gotz et al. | 102/527 |
| 4,552,071 | A | | 11/1985 | Horais | |
| H167 | H | | 12/1986 | Forster | |
| 4,907,513 | A | | 3/1990 | Manion | |
| 4,911,079 | A | * | 3/1990 | Sauvestre | 102/439 |
| 5,012,991 | A | | 5/1991 | Pinson | |
| 5,227,580 | A | * | 7/1993 | Berville et al. | 102/521 |
| 5,589,658 | A | * | 12/1996 | Sauvestre | 102/521 |
| 5,723,810 | A | * | 3/1998 | Sauvestre | 102/439 |
| 5,750,919 | A | | 5/1998 | Jehle | |
| 5,929,364 | A | | 7/1999 | Tortorici | |
| 6,085,660 | A | | 7/2000 | Campoli | |
| 6,223,643 | B1 | | 5/2001 | Muller | |
| 6,237,497 | B1 | * | 5/2001 | Altenau et al. | 102/524 |
| 6,295,934 | B1 | | 10/2001 | Tepera | |
| 6,419,235 | B1 | | 7/2002 | Han | |
| 6,453,821 | B1 | | 9/2002 | Fowler | |

* cited by examiner

*Primary Examiner*—Michael J. Carone
*Assistant Examiner*—L. Semunegus
(74) *Attorney, Agent, or Firm*—George A. Levine

(57) ABSTRACT

An obturator having redundant surfaces for sealing between a projectile and a gun tube, where the obturator has at least one gun tube side cannelure. At least one projectile side cannelure is located opposite to the at least one gun tube side cannelure, where the at least one gun tube side cannelure is conformed to seal around the projectile. A tail protrudes from a rearward end of the at least one gun tube side cannelure, where the tail makes an interference fit with the smooth gun bore to make a low pressure seal.

20 Claims, 3 Drawing Sheets

OBTURATOR FOR LARGE CALIBER SMOOTH BORE AMMUNITION

FIELD OF THE INVENTION

The present invention relates to obturators for use on ammunition, and, more particularly, for obturators for use on 45 mm or higher caliber ammunition for smooth bore guns.

BACKGROUND OF THE INVENTION

Obturators are used on projectiles for sealing combustion gases and guiding the projectile through a gun tube. In operation, an obturator seals gases between both the tube/obturator and obturator/projectile interfaces. It will be appreciated that obturator design is very critical in making a good seal in the gun tube in order to attain required muzzle velocity during firing. At the same time, the obturator should promote manual round chambering and extraction without the use of significant force. Obturators are usually discarded at muzzle exit and, since the weight of obturator is considered parasitic, it should be as light as possible without sacrificing functionality.

Traditional obturators are located in the forcing cone region of a gun tube and are usually slightly super-caliber. Initial pressurization moves the obturator forward so that it is compressed between the projectile and tube to create an initial seal. As generated pressure increases, the projectile moves with the obturator forward into the straight part of a tube. As the obturator contacts the gun tube bore surface, the obturator is subsequently pushed back due to its super-caliber size. As pressure continues to increase in the gun tube, the obturator again moves forward with the projectile. Before the present invention, the aforesaid complex movement of an obturator with the projectile required an additional sealing agent between the obturator and projectile. Typically the sealing agent used is a well-known room temperature vulcanizing sealant, called JRTV.

U.S. Pat. No. 6,453,821 to Fowler, et al. issued Sep. 24, 2002, entitled "High-Temperature Obturator for a Gun-Launched Projectile," discloses an obturator for a projectile launched from a gun barrel. The obturator includes an annular ring that is fabricated from a high-temperature resistant composite material. The annular ring has an inner surface that is in contact with the projectile.

U.S. Pat. No. 6,419,235 to Han, issued Jul. 16, 2002, entitled "Segmented Obturator Ring," discloses an obturator ring comprising two or more pieces each being a little larger than semicircle of the projectile obturator ring groove circumference. Each piece at natural position has equal or smaller radius than the radius of the obturator ring groove of a projectile; therefore, each piece expands to be in the projectile groove.

U.S. Pat. No. 6,295,934 to Tepera, et al. issued Oct. 2, 2001, entitled "Mid-body Obturator for a Gun-launched Projectile," discloses an obturator for a projectile having a mid-body annular groove that includes a shaped surface. The obturator includes an annular ring having an inner surface in contact with the shaped surface of the annular groove of the projectile. The annular ring further includes an outer surface. When the projectile is in the gun barrel, the outer surface of the annular ring contacts an inner surface of a bore of the gun barrel.

U.S. Pat. No. 6,223,643 to Muller issued May 1, 2001, entitled "Obturator for a Gun," discloses an obturation assembly for a gun of the type comprising a barrel of which a rear end defines a firing chamber having an obturation seat and the gun further having a breechblock, the obturation assembly comprising: an obturation set including an annular obturator pad for sealing against the obturation seat; an obturation spindle having a shaft and a head, the shaft extending coaxially through the obturator pad; a first shim for location between the obturation set and the breechblock, and a second shim for location between the obturation set and the head of the obturation spindle.

U.S. Pat. No. 6,085,660 to Campoli issued Jul. 11, 2000, entitled "Low Spin Sabot," is directed to a discardable sabot including a first support and a second support, aft of the first support. At least one of the supports is a sealing support, configured to provide a substantially gas-tight seal with the barrel and effective to allow the sabot and the projectile to be propelled forward through the barrel by expansion of propellant gas behind the sealing support U.S. Pat. No. 5,929,364 to Tortorici, et al. issued Jul. 27, 1999, entitled "Obturator Sealing Means for a Split Wedge/Breechblock Gun," is directed to an obturator for guarding the primary sealing surfaces of a step wedge breechblock gun from post-firing residue buildup. Their device includes an active tube insert for facilitating face seal force multiplication, out of bore lip and face seals, an in bore piston polymer with expanding residue guard, and an out of bore face seal with a residue-tolerant polymer.

U.S. Pat. No. 5,750,919 to Jehle issued May 12, 1998, entitled "Self-Adjusting Obturator for Projectile Launching," discloses an obturator wherein propellant pressure forces generated within the bore of a gun barrel are applied to a projectile through a self-adjusting obturator to prevent projectile blow by of propellant explosion products. The propellant forces are transmitted through a body of shock-absorbing fluid in the obturator.

U.S. Pat. No. 5,012,991 to Pinson issued May 7, 1991, entitled "Projectile with an Obturator Incorporating a Motor," discloses a tube-launched projectile including an airframe with an open aft end, an optical fiber dispensing bobbin, and an obturator having a rocket motor attached to a hard point in the aft end of the airframe. The obturator forms a pressure vessel with insulated inner walls that contain rocket propellant and an igniter. An ejectable plug located in the rocket nozzle is expelled upon motor ignition.

U.S. Pat. No. 4,907,513 to Manion, et al. issued Mar. 13, 1990, entitled "High Volume Obturator Assembly Method," discloses an obturating band of the despun variety manufactured within the channel of a projectile assembly. A split ring polymer pre-band is clamped around the band seat of the projectile assembly and the free ends are welded together to form a continuous ring around the diameter of the projectile assembly within the encircling channel.

United States Patent Office Publication H167 to Forster, et al. published Dec. 2, 1986, entitled "Projectile Obturator," is directed to a multipurpose projectile obturator of composite, frangible construction where the obturator forms part of a projectile that is launched from an upstanding tube. The obturator is generally made up of an elastomeric band of a suitable grade of rubber.

U.S. Pat. No. 4,552,071 to Horais, et al. issued Nov. 12, 1985, entitled "Two-Piece Despin Obturator," is directed to a two-piece despin obturator mounted on a forwardly inclined obturator ramp on the projectile sidewall has a ring-shaped body of nylon-6 and a wiper band formed from Plascon nylon. The rotational velocity imparted to the ring is partially coupled as the inner surface of the ring rotates on the obturator mount of the projectile.

U.S. Pat. No. 4,444,113 to Campoli issued Apr. 24, 1984, entitled "High-Pressure Self-Sealing Obturator in Sabot Discard Projectile," is directed to a high-pressure self-sealing obturator positioned to fit on the rear of a sabot assembly in a discarding projectile assembly to prevent the obturator from backing off during initial impact of bore walls by the projectile assembly. The obturator includes an extension and a groove for snapping a case mouth into the extension. The outer surface of the obturator conforms to the bore of the gun.

U.S. Pat. No. 4,242,961 to Moredock, et al. issued Jan. 6, 1981, entitled "Chevron Grooved Decoupling Obturator," is directed to an obturator for a projectile to be fired from a rifled barrel, with the obturator being mounted on the projectile in such a way as to permit rotational slippage. An external portion of the obturator ring has a plurality of encircling slots, essentially parallel to each other, which slots are rearwardly inclined so as to define a plurality of chevron-like members designed to forcibly engage the rifling of the barrel. The interior of the obturator ring is designed to slip rotationally with respect to the projectile body portion as the projectile travels along the barrel, thereby minimizing the rotation of the projectile as a result of rifling effects.

A family of wedge shaped obturators was previously developed in the United States for 120 mm tactical tank ammunition. Both a kinetic energy style obturator and a multipurpose style obturator were designed to generate contact pressures on the surfaces they are intended to seal that are almost equal to the gas pressures they are intended to seal out. Furthermore, both known obturators are initially inserted with clearance between the obturators and the smooth gun bore and must traverse a forcing cone to provide an initial low pressure seal that is needed to seat the obturators. If the seal between the obturator and gun tube is not established at low pressure, a seal cannot be established as the obturator travels down the gun tube.

Thus a significant drawback of known obturators is that they are not compliant enough to maintain a good seal with a changing gun tube profile. The U.S. Army's Tank Extended Range Munition-Kinetic Energy ("TERM-KE"), now called Medium Range Munition ("MRM"), projectile requires pre-translation of a round into the tube. Further, since obturators travel with the projectile, obturators will likewise be pre-translated into the tube. A puller sabot, for example, requires the obturator to be located forward of the forcing cone, this requires the obturator to be sub-caliber.

Referring now to FIG. 1, an example of an obturator for a projectile is shown in a partial cross-sectional view. There shown is an obturator 10 within a gun tube 12. The obturator 10 encircles a sabot 5 that, in turn holds a flight projectile 16. In accordance with prior art methods a JRTV or equivalent rubber-like material 14 fills gaps between the obturator and the sabot 5 and flight projectile 16. The JRTV material 14, while intended to maintain a seal, is difficult to work with in assembling the parts, and may pull away from abutting surfaces when the round is chambered. See, for example, FIG. 1 of U.S. Pat. No. 4,444,113, showing "rubber-like cover 38."

When a round is chambered in a gun tube pressure tends to move the obturator forward within the gun tube and radially outward to seal against the gun tube bore. However, as soon as the obturator contacts the gun tube bore, the resultant contact tends to push back on the obturator while the projectile is still moving forward. As the obturator moves back the JRTV under pressure pushes up against the projectile and the obturator loses contact with the JRTV opening a small crack between the obturator and the JRTV. As a result the desired seal is destroyed producing unwanted leaks that detrimentally effect performance upon firing the round.

The present invention avoids the drawbacks of the prior art, particularly with respect to eliminating dependence on JRTV for sealing.

SUMMARY OF THE INVENTION

The present invention provides an obturator for sealing between a projectile and a gun tube. The obturator includes at least one gun tube side cannelure. At least one projectile side cannelure is located opposite to the at least one gun tube side cannelure, where the at least one gun tube side cannelure is conformed to seal around the projectile. A tail protrudes from a rearward end of the at least one gun tube side cannelure, where the tail makes contact with the bore to make a low pressure seal. Initially, the tail may or may not interfere with the bore.

In contrast to the prior art, the invention provides obturators offering a lightweight mechanism to seal the gases in puller sabot, cased telescoped ammunitions ("CTA") and/or ammunition used with a conventional tube having a forcing cone without dependence on JRTV sealing material for sealing between the obturator and the projectile.

In one aspect of the invention an obturator for puller sabots and CTA's includes a flexible tail that provides an initial seal between tube and obturator. It also includes cannelures to provide significant seal all through the travel of a projectile through a gun tube.

In one aspect of the present invention an obturator generates contact pressure that is substantially greater than the gas pressure it is required to seal and the obturator includes flexible components that maintain the seal even when encountering sudden changes in bore diameter so that seal will be maintained under all conditions.

In another aspect an obturator constructed in accordance with the present invention includes a plurality of cannelures between the projectile and the obturator and also between the obturator and the gun tube, where the plurality of cannelures are combined with a moving wedge to generate very high contact pressures.

In another aspect an obturator constructed in accordance with the present invention is lightweight, compliant with changing gun tube profile, has no dependence on use of JRTV.

DETAILED DESCRIPTION OF THE PREFERRED EMBODIMENTS

While the invention will be described herein with respect to certain specific useful embodiments, it will be understood that these examples are by way of illustration and that the invention is not limited by these examples. For example, while particular reference is made to cartridges over 45 mm, it will be apparent that the obturator of the invention has applicability to a wide range of cartridge sizes and types.

Figure 1:
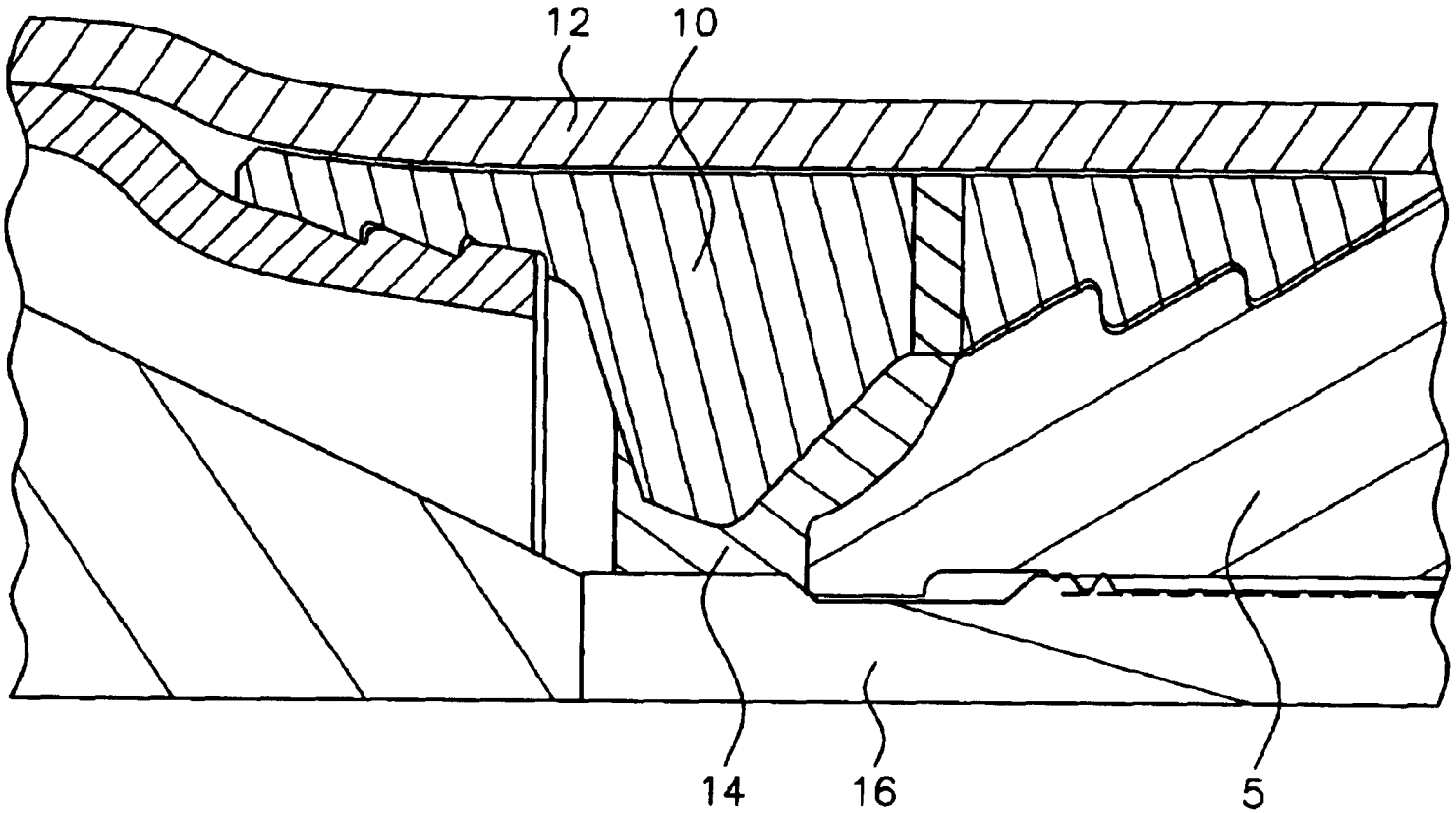
FIG. 1 (Prior Art)
FIG. 1 illustrates a partial cross-sectional schematic view of an example of an obturator of the prior art.
Figure 2:
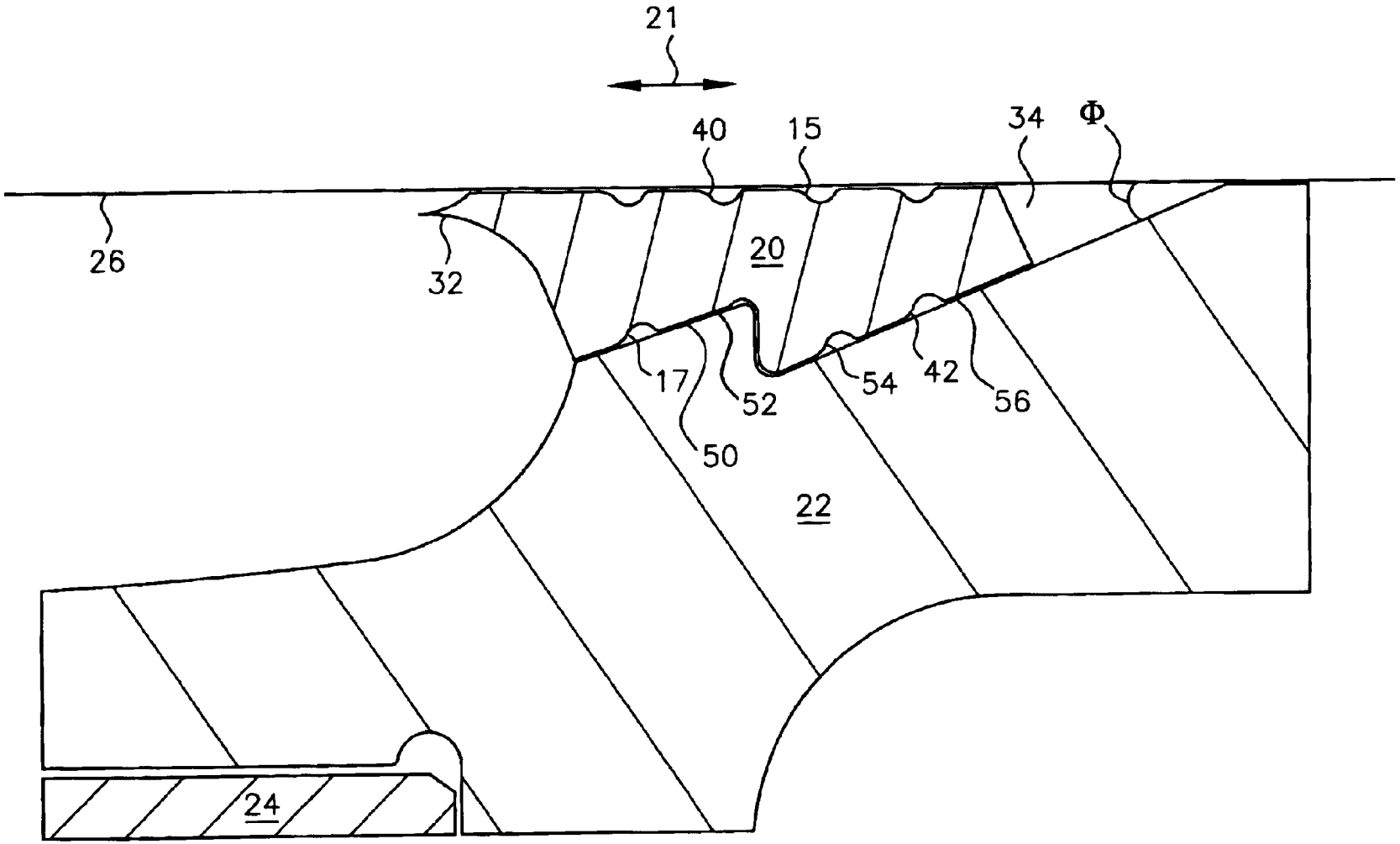
FIG. 2 illustrates a partial cross-sectional schematic view of an example of an obturator for sealing a gun tube constructed in accordance with another aspect of the present invention.

Referring now to FIG. 2, there shown is a partial cross-sectional schematic view of an example of an obturator for sealing a gun tube constructed in accordance with one aspect of the present invention. An obturator 20 has at least one gun tube side cannelure 15 and at least one projectile side cannelure 17. A sabot 22 encases a flight projectile 24. The at least one gun tube side cannelure 15 may advantageously be conformed to seal around the obturator 20. Aft pressure will force the body of the obturator into the gap between the sabot 22 and the gun tube 26. This forward action of the obturator also helps the obturator fit a variety of smooth gun bore profiles. Generated upward pressures will ultimately blow the obturator off the projectile on muzzle exit.

The gun tube includes a smooth gun bore 26 for containing a projectile. The obturator 20 utilizes a tail 32 as part of the obturator 20. The tail 32 preferably makes an interference fit with the smooth gun bore to assure an initial low pressure seal. A quality low pressure seal is desirable because, if enough gas leaks above the obturator 20, the surface between the obturator 20 and smooth gun bore 26 may not seal. In one useful embodiment of an obturator constructed in accordance with the present invention, the tail 32 is thinner than the rest of the obturator so as to be flexible enough to permit a low chambering force.

The main body of the obturator 20 comprises a wedge that fits a wedge-shaped gap 34 between the sabot 22 and the smooth gun bore 26. The wedge-shaped gap 34 has a wedge angle Φ. In contrast to other designs, the wedge angle Φ may advantageously be smaller than previous technology wedge shaped obturators that generate higher normal forces on the surfaces that require sealing. While the wedge angle Φ may be almost any angle with respect to a horizontal surface described by the smooth gun bore, in one embodiment the wedge angle Φ may be less than 30°, in another example embodiment the wedge angle Φ may be less than 10°. Prior to this invention, obturators typically had wedge angles of 30°.

Because an obturator constructed in accordance with the present invention may have a smaller wedge angle Φ, the walls of the obturator 20 may advantageously be made thin enough to allow fabrication by injection molding. In one example, the obturator may be made having a thickness of 0.25 inches (6.35 mm) or less. The obturator may advantageously be made from extruded bar stock, or molded in place in contrast to existing obturators having thick surfaces that require expensive machining. The obturator may also comprise an extruded and machined part.

In a preferred embodiment, the obturator substantially comprises nylon material, such as nylon 6-6 ($C_{12}H_{22}O_2N_2$), nylon 6-12 ($C_{18}H_{34}O_2N_2$) or a polymer, homopolymer or resin.

The obturator 20 includes an upper surface 40 and a lower surface 42. The at least one gun tube side cannelure 15 and at least one projectile side cannelure 17 are designed into both the upper and lower surfaces of the obturator 20 so that the normal forces are converted into contact pressures that are much higher than the gas pressure that drives the obturator 20 forward. The result of this pressure multiplying design is that the surface contact pressures are able to shut out and seal the substantially lower pressure gas. As pressure increases or smooth gun bore diameter changes, the obturator is pressed forward or backward in the wedge-shaped gap as needed to accommodate these changes. The tail 32 helps insure that there are no significant leaks while the wedge 34 accommodates to any changing pressure or diametric conditions. Note that this design develops high sealing contact pressures without the need to rely on the adhesion of any secondary material such as JRTV.

Still referring to FIG. 2, the obturator 20, in contrast to traditional designs, is not completely captured in place, but slides along the surface of the sabot 22, generally parallel to the gun tube, along the direction of double arrow 21, as the obturator contacts the smooth gun bore 26. A slight interference fit exists between the obturator 20 and the sabot 22 such that the obturator serves as a retaining ring around the sabot 22, thus holding the projectile assembly together. However, the obturator 20 slides to enable it to make contact against the smooth gun bore 26. The obturator may slide about 0.1 inches (2.54 mm) in either direction.

Note that the at least one projectile side cannelure 17 is offset such that a first set of cannelures 50 contact a first surface 52 of the sabot 22, while a second set of cannelures 54 contact a second surface 56 of the sabot 22, where the second surface has a different inner diameter than the first surface so as to be offset from the first surface. In this way, the obturator 20 provides a redundant seal. That is, should one of the cannelure portions fail, the second, redundant surface maintains a seal. It is not necessary that the contact surfaces 52, 56 are parallel, but they could have different angles as measured relative to the smooth gun bore, for example.

Figure 3:
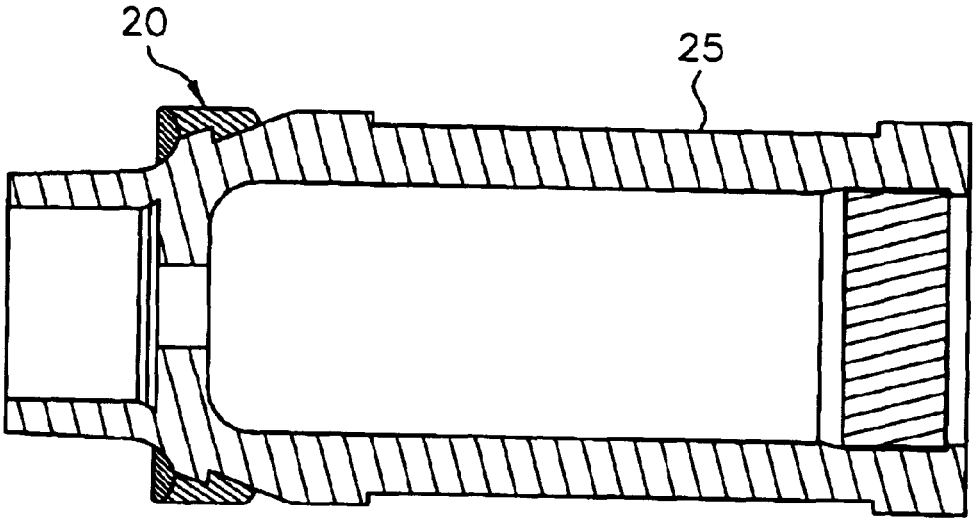
FIG. 3 shows one example of a projectile subassembly including an example obturator built in accordance with the present invention.

Referring now to FIG. 3 there shown is a projectile subassembly including an example obturator built in accordance with the present invention. A projectile subassembly 25 includes an obturator 20. In this example, the subassembly 25 is constructed to meet requirements of U.S. Army cartridges. The obturator 20 is constructed to conform to a U.S. Army cartridge profile. The projectile subassembly 25 may comprise a training round, such as, for example, a slug, a tactical kinetic energy round or a chemical energy round depending on the application. In another example, the projectile subassembly 25 and the obturator 20 may comprise a multipurpose round for use against targets such as, for example, armor, buildings and bunkers. The projectile subassembly 25 and obturator 20 may have a caliber of more than 45 mm.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by specifically different equipment and devices, and that various modifications, both as to the equipment details and operating procedures, may be accomplished without departing from the true spirit and scope of the present invention.

What is claimed is:

1. An obturator for sealing between a projectile and a gun tube having a smooth gun bore, the obturator comprising:

at least one gun tube side cannelure;

at least one projectile side cannelure located opposite to the at least one gun tube side cannelure, where the at least one gun tube side cannelure is conformed to seal around the projectile; and a tail protruding from a rearward end of the at least one gun tube side cannelure, where the tail makes contact with the bore to make a low pressure seal.

2. The obturator of claim 1 wherein the obturator comprises material selected from the group consisting of nylon, nylon 6-6 ($C_{12}H_{22}O_2N_2$), nylon 6-12 ($C_{18}H_{34}O_2N_2$), polymer, homopolymer and resin.

3. The obturator of claim 1 wherein the projectile comprises a sabot.

4. The obturator of claim 1 wherein the at least one projectile side cannelure comprises a first set of cannelures that contact a first surface of the projectile, and a second set of cannelures that contact a second surface of the projectile, where the second surface has a different circumference from the first surface so as to be offset from the first surface so as to provide a redundant seal.

5. The obturator of claim 4 wherein the obturator slides along the surface of the projectile, as the obturator contacts the smooth gun bore, where an interference fit exists between the obturator and the projectile such that the obturator serves as a retaining ring around the projectile.

6. The obturator of claim 1 wherein the obturator comprises a wedge that fits a wedge-shaped gap between the projectile and the smooth gun bore.

7. The obturator of claim 6 wherein the wedge has a wedge angle Φ between the projectile and the gun tube bore, wherein the wedge angle Φ is less than 10°.

8. The obturator of claim 7 wherein the wedge angle Φ is greater than 10°, but less 40°.

9. The obturator of claim 7 wherein the wedge angle Φ is greater than 10°.

10. The obturator of claim 1 wherein the obturator has a thickness of 0.25 inches (6.35 mm) or less.

11. The obturator of claim 10 wherein the obturator comprises material selected from the group consisting of nylon, nylon 6-6 ($C_{12}H_{22}O_2N_2$), nylon 6-12 ($C_{18}H_{34}O_2N_2$), polymer, homopolymer and resin.

12. The obturator of claim 1 wherein the tail is thinner than the rest of the obturator so as to be flexible enough to permit a low chambering force.

13. The obturator of claim 1 wherein the projectile is selected from the group consisting of a puller sabot munition, a cased telescoped munition, a munition for use with a gun tube having a forcing cone, a training round, a slug, a tactical kinetic energy round, a chemical energy round, and a multipurpose round.

14. The obturator of claim 1 wherein the projectile and obturator have a caliber of more than 45 mm.

15. The obturator of claim 1 wherein the projectile and obturator have a caliber of more than 90 mm.

16. The obturator of claim 1 wherein the obturator comprises an injection molded part.

17. The obturator of claim 1 wherein the obturator comprises a molded part or an extruded and machined part.

18. The obturator of claim 1 wherein the obturator comprises a part that is molded in place on the projectile.

19. An obturator for sealing between a projectile and a gun tube having a smooth gun bore, the obturator comprising:

at least one gun tube side cannelure;

at least one projectile side cannelure located opposite to the at least one gun tube side cannelure, where the at least one gun tube side cannelure is conformed to seal around the projectile; and a tail protruding from a rearward end of the at least one gun tube side cannelure, where the tail makes contact with the smooth gun bore to make a low pressure seal, wherein the obturator slides along the surface of the projectile, as the obturator contacts the smooth gun bore, where an interference fit exists between the obturator and the projectile such that the obturator serves as a retaining ring around the projectile, and wherein the at least one projectile side cannelure has a first set of cannelures that contact a first surface of the projectile, and a second set of cannelures that contact a second surface of the projectile, where the second surface has a different circumference from the first surface so as to be offset from the first surface so as to provide a redundant seal.

20. The obturator of claim 19 wherein the obturator comprises material selected from the group consisting of nylon, 6-6 ($C_{12}H_{22}O_2N_2$), nylon 6-12 ($C_{18}H_{34}O_2N_2$), polymer, homopolymer and resin.

* * * * *